United States Patent [19]

Graham

[11] 4,060,244

[45] Nov. 29, 1977

[54] RETRACTABLE ANCHORS FOR GAME BASES

[76] Inventor: Robert E. Graham, 2041 Wilson Road, Knoxville, Tenn. 37912

[21] Appl. No.: 579,923

[22] Filed: May 22, 1975

[51] Int. Cl.[2] ..... A63B 71/00

[52] U.S. Cl. ..... 273/25; 119/124

[58] Field of Search ..... 273/25; 114/206; 248/6; 5/253; 272/79 R, 81, 82, 83 R; 119/121, 122, 123, 124, 125; 267/69, 70, 71, 168, 114, 73, 25

[56] References Cited

U.S. PATENT DOCUMENTS

| | | | |
|---|---|---|---|
| 236,581 | 1/1881 | Haworth | 267/74 |
| 248,563 | 10/1881 | Percy | 267/71 |
| 346,771 | 8/1886 | Phillips | 267/71 R |
| 543,624 | 7/1895 | Hanson | 119/124 |
| 854,087 | 5/1907 | Hainlin | 267/69 |
| 924,913 | 6/1909 | Mellen et al. | 267/71 X |
| 967,403 | 8/1910 | Marley | 272/83 R |
| 1,295,065 | 2/1919 | Riley et al. | 267/71 X |
| 2,275,547 | 3/1942 | Mouch | 273/25 |
| 3,572,705 | 3/1971 | Wyble | 273/25 |

*Primary Examiner*—Richard C. Pinkham
*Assistant Examiner*—T. Brown
*Attorney, Agent, or Firm*—Martin J. Skinner

[57] ABSTRACT

An anchor unit is described for releasably securing bases used in baseball, softball and the like at their appropriate position on a playing field. This unit is normally for permanent installation and yet permits periodic conditioning, e.g., dragging, of the surface of the field. The anchor is useful with any standard base, and that portion which engages the base retracts below the ground level when not in use. The anchor unit is comprised of an elongated hollow tubular body member having one of its ends closed by a cap. The cap is provided with a central aperture which receives a rod which extends into the body member and longitudinally along the longitudinal axis thereof, one end of the rod being in the interior of the body member while the other end of the rod extends outwardly of the body member adjacent the cap and forms a base strap engaging loop. A spacer disk is attached to the end of the rod interiorly of the body member. A helical spring is positioned within the body member, around the rod and between the cap and spacer disk such that the rod is biased inwardly of the body member. In use, the anchor unit is vertically placed slightly below the surface of the playing field with the loop end of the rod exposed for attachment of a base strap for anchoring a base to the anchor unit.

3 Claims, 4 Drawing Figures

RETRACTABLE ANCHORS FOR GAME BASES

BACKGROUND OF THE INVENTION

The present development relates generally to outdoor sport equipment and more particularly to the securing or anchoring of bases for the games of softball, baseball and the like.

The padded bases used in softball and baseball, for first, second and third base, must be positioned at specific locations on the playing field and must resist substantial lateral movement. Preferably, there should be no lateral movement except the compression of the base itself. The specific location (distance between bases) differs for softball and baseball and for the various classes within each of these sports. Frequently a ball field is utilized at different times for several of the types of ball games, particularly in public recreation programs, and thus bases must be reset at the required distances for the specific use. In addition, the field must be periodically conditioned, as by dragging, to eliminate wear patterns around bases and along base lines. Also, it is normally desirable to remove the bases for storage after completion of a game to prevent damage from the environment or by vandalism.

A variety of anchors for the bases are known in the art. The simplest form known, and one that is widely used, is a simple spike for insertion in the ground, the spike having a loop at the top to engage a strap which is provided with the base. The spike may be straight, as illustrated in U.S. Pat. No. 2,220,142, or may be spiraled as typically illustrated in U.S. Pat. Nos. 3,466,039, 3,743,289, 3,815,905 and 3,836,146. Although this unit is inexpensive, it must be removed if the ground is to be smoothed, if the base line length must be changed, or for any other similar reason. This requires a remeasurement to ascertain the proper location of the base anchor.

Another general type of base anchor utilizes a portion permanently located in the ground and an interconnecting portion on the base itself. Several are known that have telescoping portions with a hollow member in the ground to receive a solid member depending from the base. One of these versions is known in the trade as a "hollywood" base anchor. Specific designs are typically shown in U.S. Pat. Nos. 3,126,203, 3,204,958 and 3,508,747. Certain designs have the disadvantage that a special base must be used; if a base deteriorates from use, the complete unit must be replaced. In addition, dragging of the field fills the socket thus preventing insertion of the solid portion affixed to the base.

Although lateral movement of a base is generally considered to be detrimental, some base anchors are designed to permit a limited movement to minimize physical damage to players. Such anchors are typically illustrated by U.S. Pat. Nos. 1,244,044 and 2,947,570.

SUMMARY OF THE INVENTION

The anchor of my invention has features to overcome the above-cited disadvantages of the prior art. The entire anchor unit may be installed in the soil at a depth permitting periodic dragging of the surface; however, a retractable portion may be elevated to engage a strap or loop on any conventional base. Accordingly, anchor units are permanently installed at each base location so that the bases may be quickly installed, removed or moved to change the base line length.

In its simplest form, my invention comprises an elongated hollow body member for mounting vertically in the soil, an axially-movable rod positioned along the axis of the body and projecting from one end thereof with a hook to engage a base, and means within the body to normally retain a major portion of the rod within the body. In a preferred embodiment, this means is a helical spring connected between the rod and the body. Furthermore, the preferred embodiment includes: a seal to minimize introduction of water or soil into the body; and radial arms extending from the body to increase stability within the soil or a cement surroundings.

DETAILED DESCRIPTION

Figure 1:
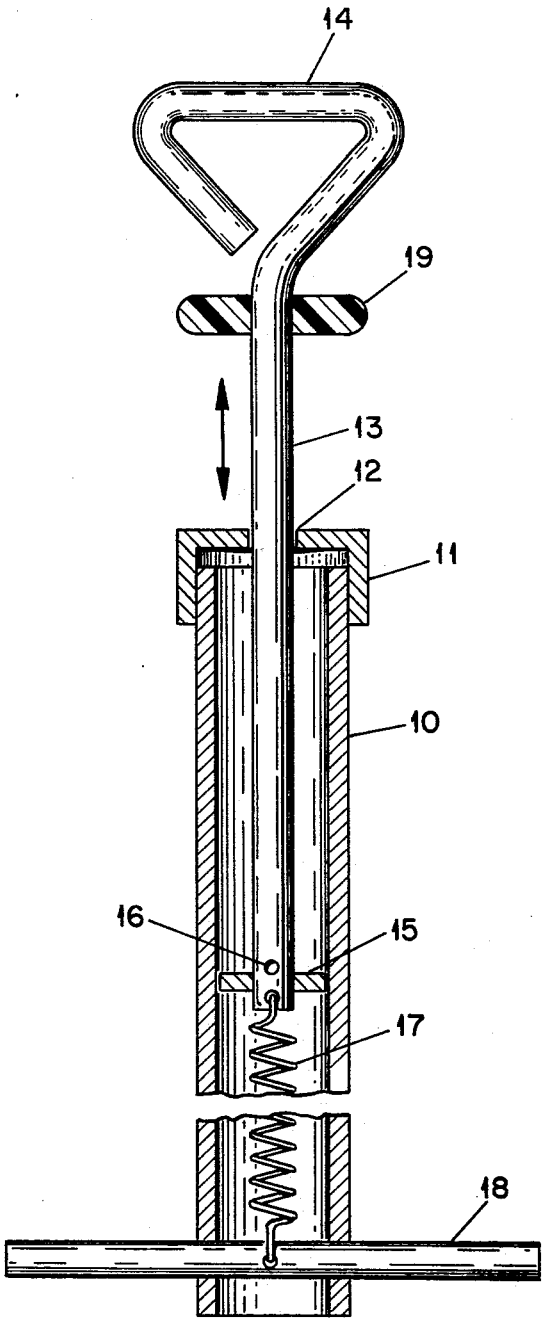
FIG. 1 is a cross sectional view of one embodiment of my base anchor.

A typical embodiment of my improved base anchor is illustrated in cross section in FIG. 1. A hollow body member 10 is partially closed at one end (top) with a cap 11 provided with a central aperture 12. The body 10 may be circular in cross section although this is not a restriction as other cross sections may be utilized. A shaft or rod 13 passes through aperture 12 and extends along a portion of the axis of the body 10. The portion of the rod 13 external to cap 11 is formed into a hook or loop 14, and the portion within the body 10 is maintained on the axis by a disk 15 attached near the second end of the rod. The disk attachment may be by welding, swaging or by transverse pin 16 through the rod 13. Attached to the second end of the rod is one end of a helical spring 17 having its second extremity connected to the body 10, in this case through a cross arm 18 which extends exterior to the body 10 for further stabilizing the anchor unit. External the cap 11 and surrounding rod 13 is a seal member 19 which, when the rod is retracted, seals the remainder of aperature 12 to minimize entry of dirt or water into the body 10. Alternatively, the seal may form a portion of cap 11 as a grommet for rod 13 (as in FIG. 2).

Figure 2:
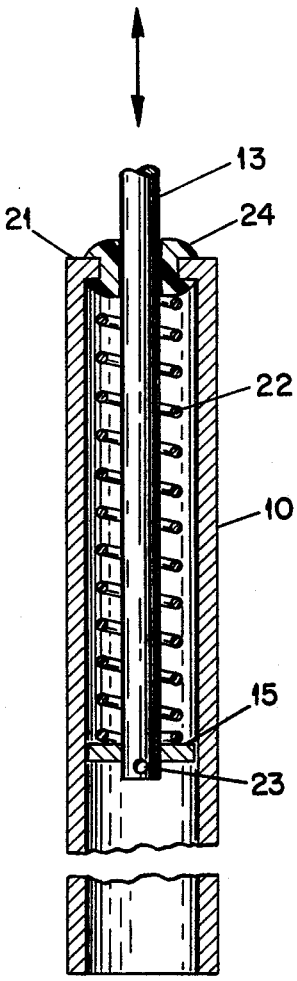
FIG. 2 is a cross sectional view of another embodiment of my invention.

A second embodiment of my base anchor is illustrated in FIG. 2. As above, a rod 13 extends along a portion of a hollow body 10 and is provided with a spacer disk 15. The principal distinctions of this embodiment are the integral cap 21 as part of the body 10 (in contrast with the removable cap 11 of FIG. 1) and a helical spring 22 which encircles rod 13 and bears against the under side of cap 21 and the top of disk 15. Disk 15 is retained on rod 13 by pin 23 or other suitable means. In the figure, a dust-water seal 24 is provided as a grommet within integral cap 21. It will be recognized that the integral cap 21 and the removable cap 11 (of FIG. 1) will function equally with spring 22. Although not shown, rod 13 terminates in a loop or hook above the body 10, and a cross arm may be used as in the embodiment of FIG. 1.

Figure 3:
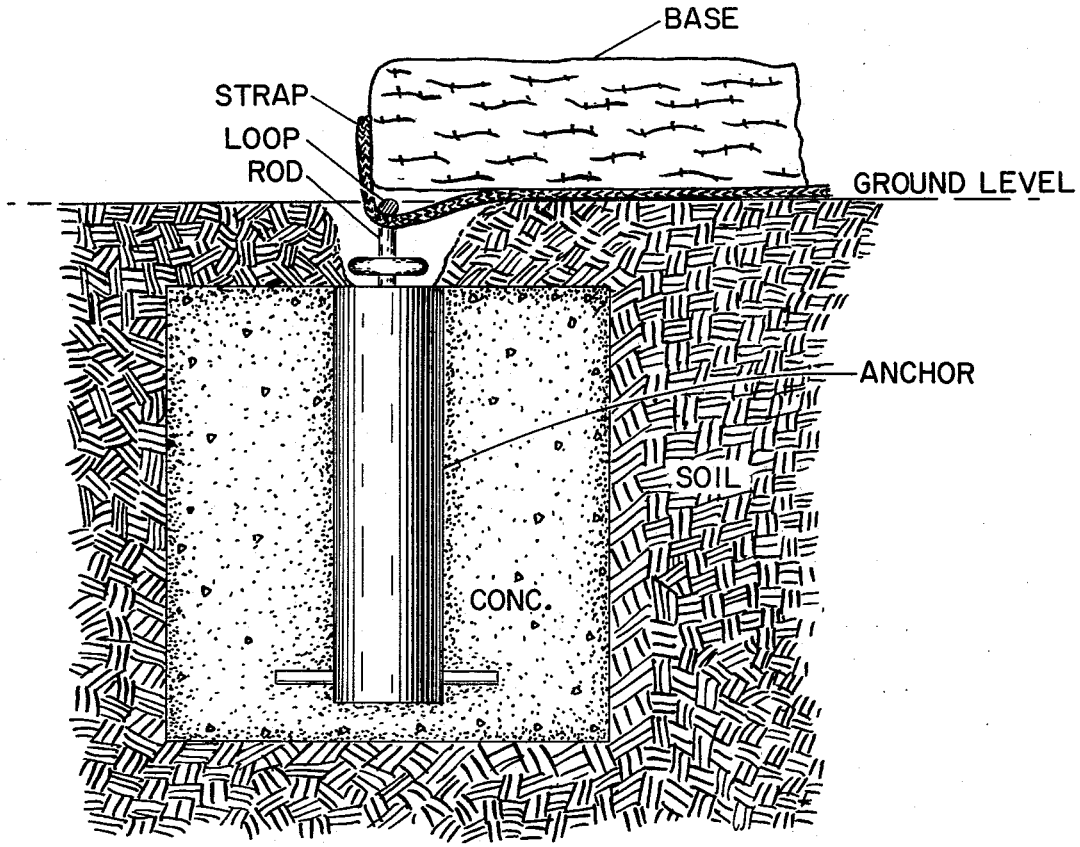
FIG. 3 is a drawing illustrating the use of my invention for the securing of a base to a playing field.

The manner of use of my invention is illustrated in FIG. 3. Although only one anchor may be used per base, preferably two to four anchor units are inserted in the ground in a vertical orientation (only one shown). Each may be, for example, surrounded by concrete to give additional stability. The plurality of anchor units prevents lateral movement of the base during use. The anchors are positioned to engage conventional base straps near the edge of the base to reduce rotation or lateral movement of the base during play. A set of anchors is positioned whereever a base may be required for the different classes of games to be played on the field. The anchors are set at a depth such that the top of the loop 14 is slightly below ground level when retracted. This permits smoothing the field when necessary using drag equipment.

When a base is to be attached, the loops of the anchors are raised to engage the base straps. This causes the spring in each to be deformed (spring 17 of FIG. 1 to be extended or spring 22 of FIG. 2 to be compressed). This deformation results in partial retraction of the loop when the base is attached or complete retraction when the base is removed. Accordingly, the base is held snugly against the ground surface at the properly designated position on the field.

My anchor, as described, does not require a special base as do many anchors of the prior art. Essentially all commercial bases are provided a pair of orthogonal straps passing through the base and extending across the lower surface where each is provided with a buckle to adjustably connect the ends thereof. These conventional straps will engage with the loop of my anchor as described above.

Figure 4:
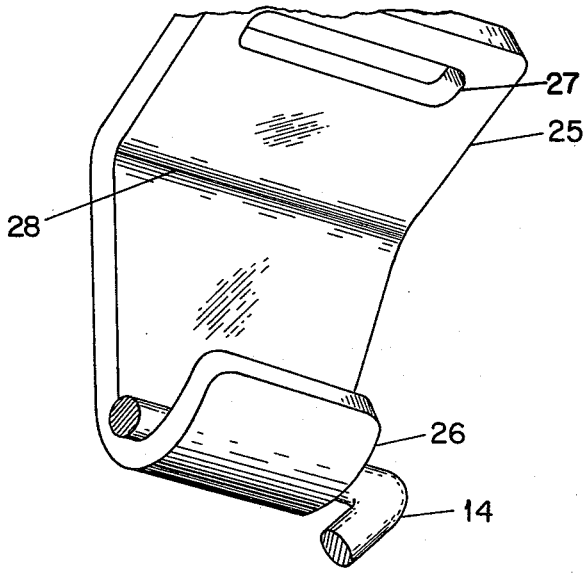
FIG. 4 is a drawing illustrating a clip which may be used to attach a conventional base to my base anchor.

In some instances, it may be desirable to utilize an intermediary element between the anchor loop and the straps of the base. Such a unit is shown in FIG. 4. A generally flat body member 25, fabricated preferably of a durable plastic, is formed with a "J-shaped" hook portion 26 at one end. Near the opposite end the body member 25 is provided with an elongated aperture 27. The aperture 27 permits a base strap (not shown) to be threaded therethrough and fastened back upon itself as by sewing or riveting. Alternatively, a second aperture (not shown) may be provided to permit threading of the strap and thus provide for adjustment of the length of a base strap. The hook portion 26 is provided to releasibly engage with the loop of my anchor unit. A slight bend 28 may be provided in the body member 25 to facilitate use of the clip beneath the base.

My invention may be fabricated from a variety of materials. For example, the body 10 and cap 11 (of FIG. 1) may be conventional metallic pipe or conduit components or may be especially fabricated. These components may also be fabricated from rigid plastics, e.g., polyvinylchloride, and thus may be extruded or molded. Similarly, the internal components as well as the rod may be either metal or plastic depending upon the preferred manner of production.

Retraction means other than springs may be utilized in my anchor although the springs appear to be preferred. For example, the bottom end of rod 13 may simply be weighted sufficiently to cause the rod to be retracted when not connected to a base. Similarly, an elastomer, a bellows or other resilient element may be used.

Although my anchor unit was developed for use with baseball and softball, its use is not limited to that application. It should find use wherever a "tiedown" anchor is desired at a fixed position.

I claim:

1. A retractable game base anchor for permanent installation in a vertical orientation beneath the surface of a playing field, said anchor having a portion thereof for extending above said surface to engage a game base when in use and retract below said surface when not in use, which comprises:

a hollow tubular body member for positioning in said vertical orientation beneath said surface;

a closure covering the upper end of said body member when so oriented, said closure being provided with a central aperture;

a rigid cross arm engaged with the lower end of said body member and extending outwardly from opposite sides thereof to aid in stabilizing said body member, when in use, below said playing field surface;

an axially movable rod disposed along the longitudinal axis of said body member and extending through said central aperture, with a first end of said rod being within said body member and a second end of said rod being exterior of said body member, said second end being formed into a loop, a portion of said loop most distant from said body member being a straight section perpendicular to said rod;

a non-sealing spacer disk encircling and fixedly engaged to said first end of said rod interiorly of said body member to maintain said first end of said rod on the longitudinal axis of said body member; and an elongated helical spring within said body member having an axis extending along the longitudinal axis of said body member, a first end of said spring engaged with said spacer disk, and a second end engaged with said closure cover whereby said loop is normally retained in a retracted position adjacent said closure but whereby said loop may be elevated above said surface to engage said game base.

2. The anchor of claim 1 wherein said closure cover is a resilient dirt seal surrounding said rod at said aperture.

3. The anchor of claim 1 further comprising a releasable base-attaching clip for engagement with said straight portion of said loop, said clip being a generally L-shaped body member, one end of which is folded into a substantially J-shaped hook configuration for passing through said loop, and the opposite end of said clip body being provided with a transverse elongated aperture for passage of a game base connecting strap for connecting a game base thereto.

* * * * *